US006598438B2

(12) United States Patent
Ashby

(10) Patent No.: US 6,598,438 B2
(45) Date of Patent: Jul. 29, 2003

(54) KEY WRENCH

(76) Inventor: Brendan Evans Ashby, 2803 Bernadette La., Houston, TX (US) 77043

( * ) Notice: Subject to any disclaimer, the term of this patent is extended or adjusted under 35 U.S.C. 154(b) by 0 days.

(21) Appl. No.: 10/120,674

(22) Filed: Apr. 11, 2002

(65) Prior Publication Data

US 2002/0148264 A1 Oct. 17, 2002

Related U.S. Application Data

(60) Provisional application No. 60/283,241, filed on Apr. 11, 2001.

(51) Int. Cl.[7] ..... E05B 19/04

(52) U.S. Cl. ..... 70/408; 70/456 R; D8/347; D3/61

(58) Field of Search ..... 70/408, 456 R, 70/395, 458; D3/61, 65; D8/347, 348, 352

(56) References Cited

U.S. PATENT DOCUMENTS

| | | | | | |
|---|---|---|---|---|---|
| 4,379,394 | A | * | 4/1983 | Toyoda | 70/456 R |
| 4,516,000 | A | * | 5/1985 | Ryberg et al. | 70/408 X |
| 4,583,383 | A | * | 4/1986 | Bosco et al. | 70/408 |
| D286,465 | S | * | 11/1986 | Attwood | D3/61 |
| 4,637,238 | A | * | 1/1987 | Uda et al. | 70/456 R |
| D293,549 | S | * | 1/1988 | Stinson | D8/347 |
| 4,910,983 | A | * | 3/1990 | Taylor | 70/456 R |
| 4,991,417 | A | * | 2/1991 | Grecco | 70/408 |
| 5,058,465 | A | * | 10/1991 | Womack | 81/487 |
| 5,207,082 | A | * | 5/1993 | LeMaitre | 70/408 |
| D345,295 | S | * | 3/1994 | Davey | D8/352 |
| D361,020 | S | * | 8/1995 | Hegstrum | D8/14 |
| 5,440,910 | A | * | 8/1995 | Florian | 70/456 R |
| 5,487,291 | A | * | 1/1996 | Voigt | 70/456 R |
| D371,955 | S | * | 7/1996 | Draeger | D8/347 |
| 5,623,844 | A | * | 4/1997 | Draeger | 70/408 |
| 5,671,624 | A | * | 9/1997 | Sivils | 70/408 |
| 5,737,951 | A | * | 4/1998 | Krass | 70/456 R |
| 5,794,471 | A | * | 8/1998 | Rizzo | 70/456 R |
| 5,799,522 | A | * | 9/1998 | Ohta | 70/456 R |
| D406,046 | S | * | 2/1999 | Coe | D8/347 |
| 6,164,102 | A | * | 12/2000 | Gapco | 70/408 |

* cited by examiner

*Primary Examiner*—Suzanne Dino Barrett
(74) *Attorney, Agent, or Firm*—Andy Arismendi, Jr.

(57) ABSTRACT

An apparatus is provided for facilitating the turning of a key in a keyhole of a lock. The key has a head, an insertion portion and a connecting portion between the head and the insertion portion. The apparatus has a body for gripping by an operator and applying torque to the key. The body has at least a front surface, a back surface, a peripheral edge where the front and back surfaces meet, and a slot extending through the body between the front and back surfaces. The slot is adapted to allow the insertion portion of the key to extend beyond the front surface and engage the connecting portion when the key is inserted through the slot. In this manner, when torque is applied to the peripheral edge by the operator, the torque is transmitted through the body at least to the connecting portion of the key. This facilitates the turning of the key when the insertion portion is in the keyhole of the lock.

3 Claims, 2 Drawing Sheets

KEY WRENCH

RELATED APPLICATIONS

This application claims the benefit under 35 U.S.C. §119 (e) of prior provisional patent application No. 60/283,241, filed Apr. 11, 2001, which is hereby incorporated by reference.

BACKGROUND OF THE INVENTION

1. Field of the Invention

The present invention relates to handles, and specifically to handles or grips which are attachable to keys to facilitate their use.

2. Description of Prior Developments

Key of the type widely used for operating locks found in the doors of homes, offices, vehicles and other applications are generally planar or laminal in form. Such keys typically include a base, which is often perforated and which provides a surface to gripping and turning the key, and an integrally formed shaft projecting from the base. Integrally formed on the shaft is a series of irregularities, such as teeth, which are configured to correspond to the mating elements of the lock when inserted therein.

The act of gripping and turning the key base requires the pads of several fingers to be placed together in close proximity in a pincer-like or pinching fashion. The planar form of the key and key base is not chosen primarily for ease of use but to enable inexpensive manufacture, coding and compact storage of several keys as on a single key ring.

In general, prior key holders included various key attachments for containing one or more keys and for aiding in identifying and selecting individual keys. These prior attachments take advantage of the compact planar form of the typical key by making the key cases and holders substantially planar as well. See, for example, U.S. Pat. No. 5,487,291.

Prior key cases and holders are typically made laminal as suggested by the flat keys with which they are used. Also transferred from the key to the key holder is the requirement that the key user's fingers assume a pincer-like position to grip and twist the device holding the key. See, for example, U.S. Pat. Nos. 4,516,000 and 4,910,983. Arthritis and other debilitating medical conditions can impair digital dexterity and cause such a pinching, twisting action to be painful, awkward or even impossible to perform.

Many devices, such as eating utensils and writing instruments, have been specifically designed to minimize discomfort and enable their usage by persons afflicted as mentioned above. However, there yet appears to be a need for a device to allow the easier use of a common key.

The act of pinching a planar object often causes longer fingernails to come into contact with one another, the key, the lock or an adjacent object. This contact can damage or ruin any cosmetic treatment that has been applied to the fingernails or cuticles.

U.S. Pat. No. 3,355,917 to Albert and U.S. Pat. No. 4,583,383 to Bosco et al. create or use a generally L-shaped lever to turn a key. In Albert, the keys are swingably carried on pins attached to a key holder. In an in-use position, the insertion portion of the key forms the short leg of the L-shape. The key holder forms the long leg of the L-shape. In Bosco et al., the short end of the L-shaped lever thereof has a slot that receives the head of a key. In either case, the operator is required to hold the long leg of the lever to twist the key. This is a difficult act for persons with arthritic hands and fingers.

U.S. Pat. No. 4,637,238 to Uda et al. discloses a folding key in which a key body is pivotally mounted in a dished cap. In a storage position, the insertion portion of the key is tucked within the dished cap. To use it, the operator must pivot the insertion portion of the key from the storage position to an in-use position. The operator inserts the insertion portion of the key into the lock and rotates the key by grasping and turning a knob on the cap or the circumference of the cap. The act of pivoting the insertion portion of the key is a difficult act for a person with arthritic hands and fingers. Further, since the key is attached to the cap, multiple keys each with its own dished cap are bulky and take up too much space in a pocket or a handbag.

U.S. Pat. No. 5,058,465 to Womack discloses a device for holding a lock key firmly while inserting the key in a lock for use by a locksmith to make a key by impressioning. The device is too large and bulky for practical use by the public with arthritic hands and/or with multiple keys each having such a device.

Des. 286,465 to Attwood discloses a key holder which attaches to a key. U.S. Pat. No. 6,164,102 to Gapco discloses a bulbous hand grip to facilitate turning a key within a lock. Again, multiple keys would be a problem.

Thus, there continues to exist a need for a device to assist in turning keys, particularly for arthritic persons that are convenient and compact.

SUMMARY OF THE INVENTION

An apparatus is provided for facilitating the turning of a key in a keyhole of a lock, which may be called a key wrench. The key has a head, an insertion portion and a connecting portion between the head and the insertion portion. The apparatus has a body for gripping by an operator and applying torque to the key. The body has at least a front surface, a back surface, a peripheral edge where the front and back surfaces meet, and a slot extending through the body between the front and back surfaces. The slot is adapted to allow the insertion portion of the key to extend beyond the front surface and engage the connecting portion when the key is inserted through the slot. In this manner, when torque is applied to the peripheral edge by the operator, the torque is transmitted through the body at least to the connecting portion of the key. This facilitates the turning of the key when the insertion portion is in the keyhole of the lock.

The body may be planar or curved in shape. In a curved shape, the front surface may be concave and the back surface may be convex, or vice versa.

The peripheral edge defines a continuous closed line. The closed line may be, for example, a polygon, a circle or an ellipse. The peripheral edge may be a scalloped edge.

The body may be a paraboloidal body. In one embodiment, the paraboloidal body is a spherical section, wherein the spherical section is at most half of a corresponding sphere. Preferably, the spherical section is less than half of the corresponding sphere.

When the body is a paraboloidal body, one of the front and the back surfaces is preferably a flat surface. In such an embodiment, the slot has a main axis that is preferably substantially perpendicular to the flat surface. Preferably, the length of the slot along its main axis is at most the length from the head to but not including the insertion portion.

In a preferred embodiment, the front surface is convex, the back surface is concave, and the peripheral edge is scalloped. A hole may be provided near the peripheral edge for attachment of a key or a plurality of keys using a chain of sufficient length to allow the insertion portion of the selected key to be inserted through the slot. Less space is taken up in a pocket or handbag this way and the apparatus allows the operator to more easily locate dropped keys.

The apparatus of the present invention provides more comfortable finger surface on the peripheral edge located at an increased radial distance from the main axis of the key. This increased radial distance allows for greater leverage in turning the key. This is particularly beneficial to persons with arthritic hands and fingers.

BRIEF DESCRIPTION OF THE DRAWINGS

In the drawings and in the following description, like numerals denote the same or similar element.

DETAILED DESCRIPTION

Figure 1:
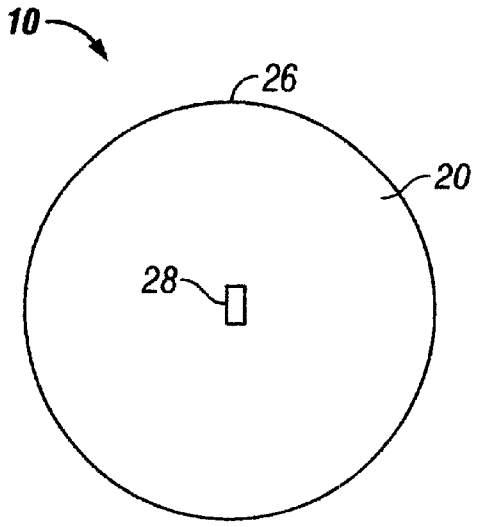
FIG. 1 is a top view of an embodiment of the apparatus of the present invention wherein the peripheral edge defines a circle.
Figure 1A:
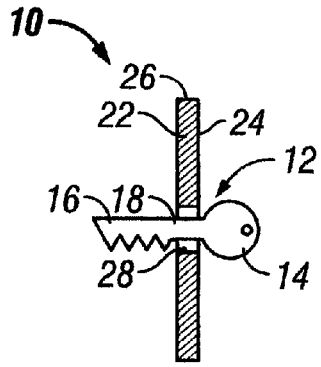
FIG. 1A is a side cross-sectional view of an embodiment of the apparatus of the present invention, wherein the cross-section may be of any of the embodiments shown in FIGS. 1, 2, 3 and 10.

Referring now to FIGS. 1 and 1A, an apparatus 10 is provided for facilitating the turning of a key 12 in a keyhole of a lock. The key 12 has a head 14, an insertion portion 16 and a connecting portion 18 between the head 12 and the insertion portion 14. The apparatus 10 has a body 20 for gripping by an operator and applying torque to the key 12. The body 20 has at least a front surface 22, a back surface 24, a peripheral edge 26 where the front and back surfaces 22, 24 meet, and a slot 28 extending through the body 20 between the front and back surfaces 22, 24. The slot 28 is adapted to allow the insertion portion 16 of the key 12 to extend beyond the front surface 22 and engage the connecting portion 18 when the key 12 is inserted through the slot 28. In this manner, when torque is applied to the peripheral edge 26 by the operator gripping the peripheral edge 26 with the operator's fingers and twisting his/her hand, the torque is transmitted through the body 20 at least to the connecting portion 18 of the key 12. This facilitates the turning of the key 12 when the insertion portion 16 is in the keyhole of the lock.

Figure 4:
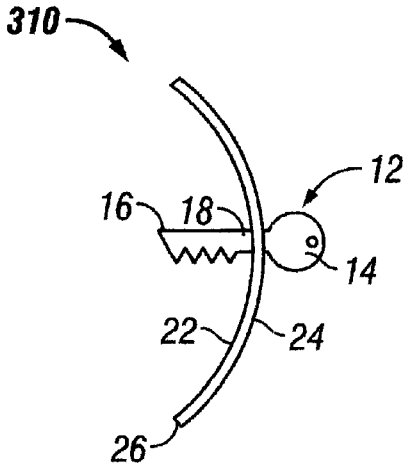
FIG. 4 is a side cross-sectional view of an embodiment of the apparatus of the present invention, wherein the cross-section may be of any of the embodiments shown in FIGS. 1, 2, 3 and 10.
Figure 5:
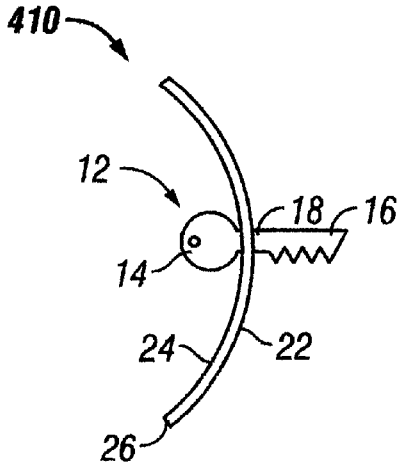
FIG. 5 is a side cross-sectional view of an embodiment of the apparatus of the present invention, wherein the cross-section may be of any of the embodiments shown in FIGS. 1, 2, 3 and 10.

The body 20 may be planar as shown in FIG. 1A or curved in shape as shown in FIGS. 4 and 5. In a curved shape, the front surface may be concave and the back surface may be convex as shown in FIG. 4, or vice versa as shown in FIG. 5.

Figure 2:
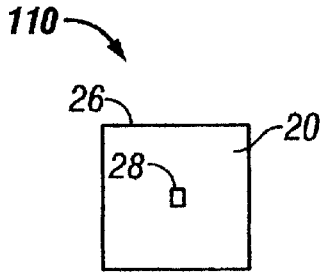
FIG. 2 is a top view of an embodiment of the apparatus of the present invention wherein the peripheral edge defines a quadrilateral, specifically a square.
Figure 3:
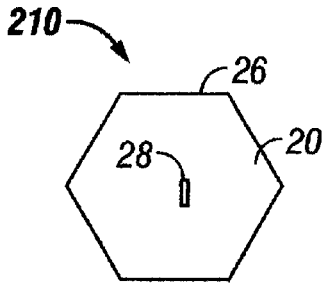
FIG. 3 is a top view of an embodiment of the apparatus of the present invention wherein the peripheral edge defines a hexagon.
Figure 8:
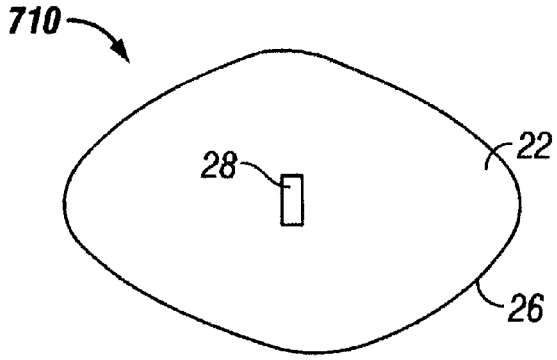
FIGS. 8 and 9 are a bottom view and a side perspective view, respectively, of an embodiment of the apparatus according to the present invention, wherein the apparatus is paraboloidal in shape, specifically a section of an ellipsoidal body.
Figure 9:
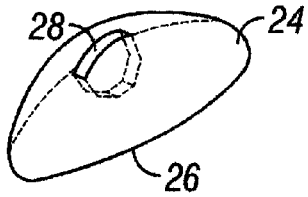

The peripheral edge 26 defines a continuous closed line. The closed line may define, for example, a polygon [see FIG. 2 a square (apparatus 110) and FIG. 3 a hexagon (apparatus 210)], a circle [see FIG. 1 (apparatus 10)] or an ellipse [see FIGS. 8 and 9(apparatus 710)]. The peripheral edge 26 may define a scalloped edge [see FIG. 10 (apparatus 810)].

Figure 6:
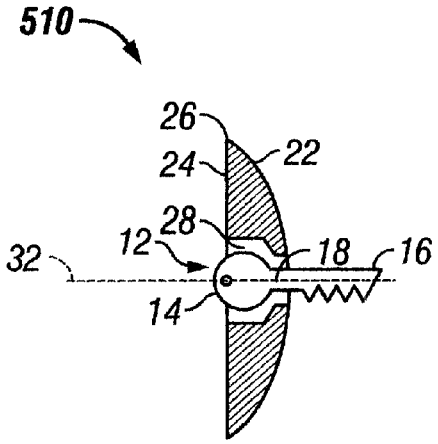
FIG. 6 is a side cross-sectional view of an embodiment of the apparatus of the present invention, wherein the cross-section may be of any of the embodiments shown in FIGS. 1 and 9.
Figure 7:
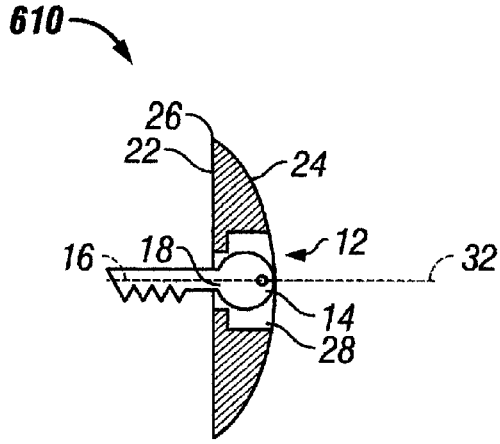
FIG. 7 is a side cross-sectional view of an embodiment of the apparatus of the present invention, wherein the cross-section may be of any of the embodiments shown in FIGS. 1 and 9.

The body 20 may be a paraboloidal body. As shown in FIGS. 6 and 7, the paraboloidal body (apparatus 510 and 610, respectively) is a spherical section, wherein the spherical section is at most half of a corresponding sphere. Preferably, the spherical section is less than half of the corresponding sphere.

When the body 20 is a paraboloidal body, one of the front and the back surfaces is preferably a flat surface. See FIG. 6, where the back surface 24 of apparatus 510 is flat; and FIG. 7, where the front surface 22 of apparatus 610 is flat. In such embodiments, the slot 28 has a main axis that is preferably substantially perpendicular to the flat surface. Preferably, as shown in FIGS. 6 and 7, the length of the slot 28 along its main axis 32 is at most the length from the head 14 to, but not including, the insertion portion 16. As shown in FIGS. 6, 7, 8 and 9, to accommodate the head 14, the slot 28 is wider at the entry point. The exit point of the slot 28 is sufficiently wide to allow the insertion portion 16 to pass therethrough.

Figure 10:
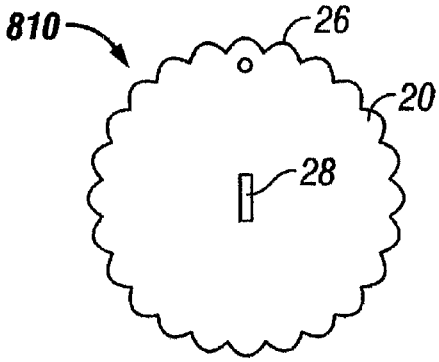
FIG. 10 is a front view of an embodiment of the apparatus of the present invention wherein the peripheral edge is scalloped.

In a preferred embodiment, the front surface 22 is convex, the back surface 24 is concave, and the peripheral edge 26 is scalloped. A front view of this embodiment would look like that shown in FIG. 10 and a side cross-sectional view thereof would appear as shown in FIG. 5. As shown in FIG. 10, a hole 30 may be provided near the peripheral edge 26 for attachment of a key 12 or a plurality of keys using a chain (not shown) of sufficient length to allow the insertion portion 16 of the selected key 12 to be inserted through the slot 28. Less space is taken up in a pocket or handbag this way and the apparatus allows the operator to more easily locate dropped keys.

The apparatus of the present invention may be made of any suitable material possessing sufficient rigidity so that the integrity of the slot 28 is maintained while imparting torque to the key 12 to open the lock. Additionally, the peripheral edge 26 preferably provides a sufficient coefficient of friction to minimize or eliminate slippage between the operator's fingers and the peripheral edge 26, when the operator imparts torque to the apparatus of the present invention. The material may be made from, for example, a metal, a plastic, a hard rubber, wood and a combination thereof.

The apparatus of the present invention provides more comfortable finger surface on the peripheral edge 26 located at an increased radial distance from the main axis of the key.

This increased radial distance allows for greater leverage in turning the key 12. This is particularly beneficial to persons with arthritic hands and fingers.

What is claimed is:

1. An apparatus for facilitating the turning of a key in a keyhole of a lock, wherein the key has a head, an insertion portion and a connecting portion between the head and the insertion portion, the apparatus comprising:

a body for gripping by an operator and applying torque to the key, the body having at least a front surface, a back surface, a peripheral edge where the front and back surfaces meet, and a slot extending through the body between the front and back surfaces, wherein the slot is adapted to allow the insertion portion to extend beyond the front surface and engage the connecting portion when the key is inserted though the slot such that when torque is applied to the peripheral edge by the operator, the torque is transmitted at least to the connecting portion of the key, wherein the front surface is concave and the back surface is convex or the front surface is convex and the back surface is concave.

2. The apparatus of claim 1, wherein the front surface is convex, the back surface is concave, and the peripheral edge is scalloped.

3. An apparatus for facilitating the turning of a key in a keyhole of a lock, wherein the key has a head, an insertion portion and a connecting portion between the head and the insertion portion, the apparatus comprising:

a body for gripping by an operator and applying torque to the key, the body having at least a front surface, a back surface, a peripheral edge where the front and back surfaces meet, and a slot extending through the body between the front and back surfaces, wherein the slot is adapted to allow the insertion portion to extend beyond the front surface and engage the connecting portion when the key is inserted through the slot such that when torque is applied to the peripheral edge by the operator, the torque is transmitted at least to the connecting portion of the key, wherein the peripheral edge is a scalloped edge.

* * * * *